United States Patent [19]

Hauger et al.

[11] Patent Number: 4,810,118

[45] Date of Patent: Mar. 7, 1989

[54] CARTRIDGE SYSTEM FOR PRINTING APPARATUS

[75] Inventors: Josef Hauger; Klaus Tauchert, both of Villingen-Schwenningen, Fed. Rep. of Germany

[73] Assignee: Kienzle Apparate GmbH, Villingen-Schwenningen, Fed. Rep. of Germany

[21] Appl. No.: 868,158

[22] Filed: May 22, 1986

Related U.S. Application Data

[63] Continuation of Ser. No. 645,806, Aug. 29, 1984, abandoned.

[30] Foreign Application Priority Data

Jun. 6, 1984 [DE] Fed. Rep. of Germany ..... 3420981

[51] Int. Cl.[4] ..... B41J 35/18

[52] U.S. Cl. ..... 400/212; 400/208; 400/216.2; 400/211

[58] Field of Search ..... 400/216.1, 82, 208, 400/56, 59, 57, 216.2, 211, 212

[56] References Cited

U.S. PATENT DOCUMENTS

| | | | |
|---|---|---|---|
| 2,062,455 | 12/1936 | Henry | 400/208 |
| 2,986,259 | 5/1961 | Salzberger | 400/59 |
| 3,425,532 | 2/1969 | Dannatt | 400/208 |
| 3,825,681 | 7/1974 | Cederberg et al. | 400/82 |
| 3,871,507 | 3/1975 | Perry | 400/208 |
| 3,877,561 | 4/1975 | Guerrini | 400/208 |
| 3,977,512 | 8/1976 | Teagarden | 400/234 |
| 4,019,617 | 4/1977 | Englund | 400/208 |
| 4,027,765 | 6/1977 | Crump et al. | 400/82 |
| 4,030,588 | 6/1977 | Hanagata | 400/320 |
| 4,134,693 | 1/1979 | Crickmore | 400/208 |
| 4,203,676 | 5/1980 | Hatsell | 400/208 |
| 4,268,181 | 5/1981 | Decker | 400/208 |
| 4,353,657 | 10/1982 | Schaefer | 400/208 |
| 4,407,595 | 10/1983 | Gershnow | 400/208 |
| 4,462,707 | 7/1984 | Falconieri | 400/208 |
| 4,472,073 | 9/1984 | Valle | 400/697.1 |
| 4,493,572 | 1/1986 | Van Ocher et al. | 400/208 |
| 4,531,852 | 7/1985 | Mädge et al. | 400/82 |

FOREIGN PATENT DOCUMENTS

| | | | |
|---|---|---|---|
| 2306836 | 11/1976 | France | 400/208 |
| 120385 | 9/1981 | Japan | 400/211 |
| 58-132581 | 8/1983 | Japan | 400/208 |
| 36185 | 2/1985 | Japan | 400/216.1 |

OTHER PUBLICATIONS

Habich, Carrier for Ribbon Cartridge, 9/80, vol. 23, No. 4, pp. 1312–1314.

*Primary Examiner*—William Pieprz

*Attorney, Agent, or Firm*—Toren, McGeady & Associates

[57] ABSTRACT

A coloring system for a printing apparatus, wherein a color ribbon is mounted within a cartridge which may be inserted within the printing apparatus so that the color ribbon is operable in cooperation with a print head to effect color printing on a recording carrier, with the print head operating from above the recording carrier and with the color ribbon being wound about a pair of spools having parallel axes arranged to extend horizontally when the cartridge is mounted in a housing of the printing apparatus, the printing apparatus including a guide and stop mechanism operable to hold the cartridge within the housing in operative position with the cartridge projecting above the housing to a degree in accordance with the dimensions of the spools upon which the color ribbon is mounted.

3 Claims, 5 Drawing Sheets

FIG. 3
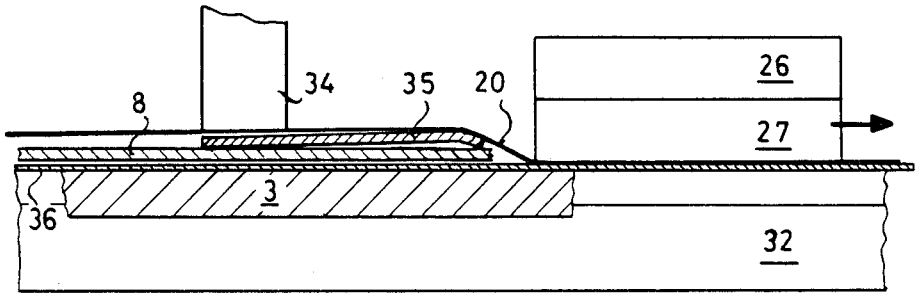
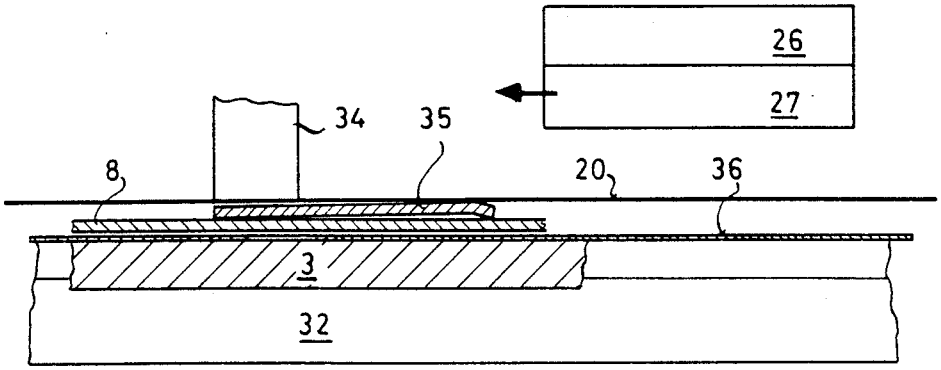
FIG. 3A

CARTRIDGE SYSTEM FOR PRINTING APPARATUS

This is a continuation of application Ser. No. 645,806, filed Aug. 29, 1984, now abandoned.

The present invention relates generally to printing apparatus having coloring capability and more specifically to a printer, wherein color is transferred to a recording carrier from a color ribbon, generally of the nonreusable type, mounted within a cartridge.

For reasons which are generally related to user convenience, almost all color ribbons in printing apparatus of the type to which the present invention relates are presently available only in color ribbon cartridges. It is usual to arrange the color ribbons in a printer frame or on a printing carriage in a position wherein the axes of the spools upon which the ribbon is mounted extend vertically, such a position being generally referred to as a "lying" position. Thus, since the color ribbons are arranged on spools having vertically extending axes, the continuous color ribbons, when inserted with their cartridges into the printing apparatus, will extend vertically during a printing pass. With the aid of postcoloring rollers and the like, it has been the practice to substantially improve the endurance or service life of the color ribbons relative to the volume of the cartridge in color ribbons which are usable repeatedly.

However, prior art approaches have tended not to solve the problem of providing sufficient color ribbon supply in devices wherein the color ribbon is utilized only one time, i.e., is not reusable. Ribbons of this type are, for example, carbon ribbons, magnetic carbon ribbons and also multi-color ribbons provided for one type use and, in such ribbons, it is necessary that the cartridges do not occupy excessive space in the printer. In a cartridge of the "lying" type, a significant criterion or characteristic involves the space which is occupied by the printer on a table or desk wherever it is set up. Accordingly, the present invention is directed toward providing a printer, particularly one equipped with a color ribbon which is used only one time, which is especially easy to utilize by making available a sufficient supply of color transfer material so that the color ribbons need not be replaced as frequently. However, a precondition involved in this type situation is that relatively large color ribbon rollers or spools be provided in order that an adequate supply of ribbon may be available. In the standard, conventional "lying" arrangement of the color ribbon cartridge, this could lead to substantial increases in the space which is occupied by the printer.

Accordingly, the invention is also directed toward providing a coloring arrangement with a cartridge for a printer, wherein the color is transferred from the ribbon to a recording carrier by means of a single use color ribbon, the device being characterized in that the cartridge is inserted in a "standing" manner in the printer, i.e., with the axes of the spool extending horizontally, whereby it is also stoppable in the "standing" position by means of guiding and stop means with the printing being effected by means of a printing head from above the carrier medium, i.e., from top to bottom via the color ribbon which is guided at the underside of the cartridge freely in front of the recording carrier and with the printing being carried out in such a way that the cartridge projects or overlaps somewhat beyond the printer housing in accordance with the dimensioning of the spools.

SUMMARY OF THE INVENTION

Briefly, the present invention may be defined as a printing apparatus with a coloring system comprising: printing head means for performing a printing operation on a recording carrier, said printing head means operating to effect said printing operation from above the recording carrier; color ribbon means operable in cooperation with the printing head means to effect colored printing on said recording carrier, said color ribbon means comprising a cartridge, a color ribbon contained within said cartridge and a pair of spools within said cartridge rotatable about a parallel axes having said color ribbon wound thereabout; a housing within which said printing apparatus is contained adapted to receive said cartridge with said parallel axes of said spools extending horizontally and with said color ribbon positioned at the underside of the cartridge guided for operative association with said recording carrier to enable said printing head means to effect a printing operation; and guide and stop means interposed between said printing apparatus and said cartridge for holding said cartridge within said housing in operative position with said cartridge projecting above said housing to a degree in accordance with the dimensioning of said spools.

Thus, with the present invention, in contrast to prior art "lying" arrangements, the standing arrangement of the color ribbon cartridge has the advantage that since the cartridge itself can project over the volume of the printer by a desired extent, any printer can be equipped with cartridges of desired dimensioning so that with respect to the color ribbon supply a selection may be made between a smaller cartridge with a smaller color ribbon supply and a larger cartridge with a supply of color transfer material which is much larger.

Of course, this "standing" arrangement of the cartridge has the disadvantage that the printing is not visible at the moment when it occurs. However, with the great speeds with which present-day data printers operate, this aspect has become of lesser importance since the printout of the data can no longer be followed by the human eye and can no longer be stopped in time when undesired data becomes apparent.

A further advantage of the arrangement of the color ribbon cartridge in accordance with the invention consists in that the cartridge is easily insertable without requiring threading of the color ribbon or other guide means during insertion. It is also unnecessary to open flaps in a housing, or to encounter similar difficulties before the color ribbon can be introduced into the printing apparatus. Thus, not only is simplification achieved, but also, there is achieved a simplified housing construction since removable or pivoting flaps are no longer necessary.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DESCRIPTION OF THE DRAWINGS

In the drawings:

FIGS. 3 and 3A each are detailed sectional views showing on an enlarged scale two functioning positions of the parts of the apparatus;

DETAILED DESCRIPTION OF THE PREFERRED EMBODIMENT

Figure 1:
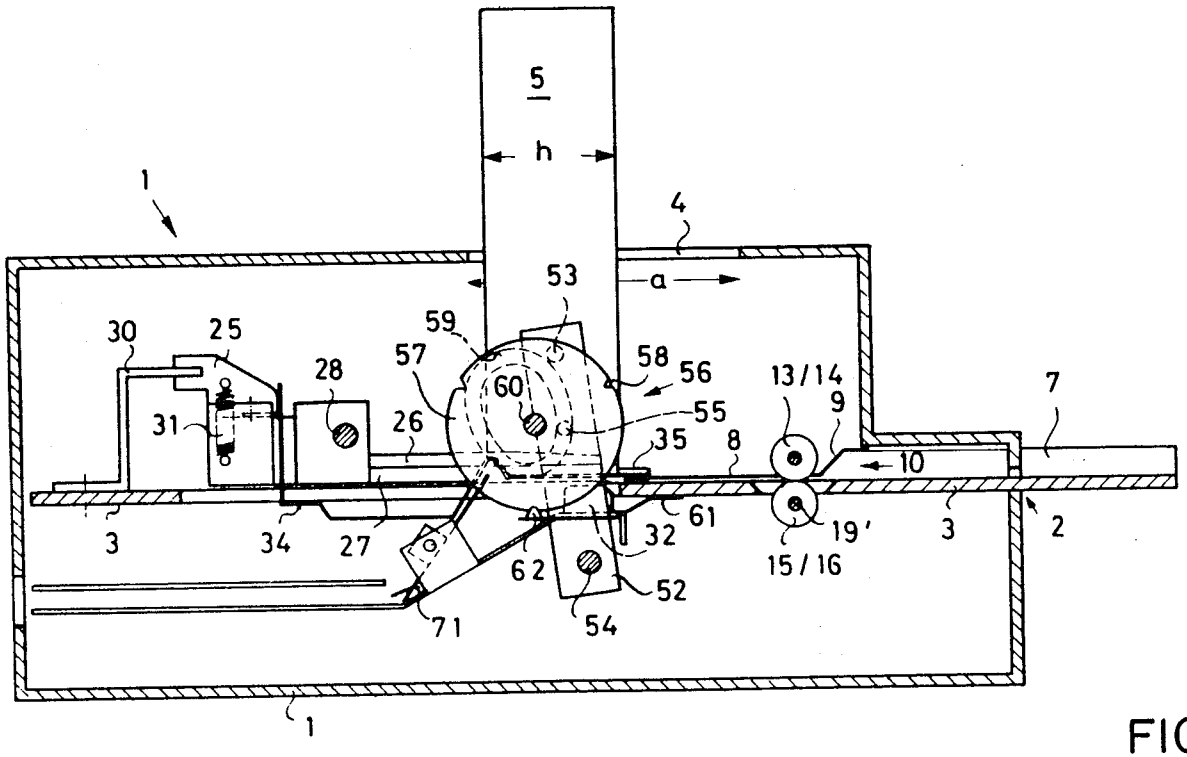
FIG. 1 is a sectional side representation schematically showing parts of the mechanism in accordance with the invention.
Figure 2:
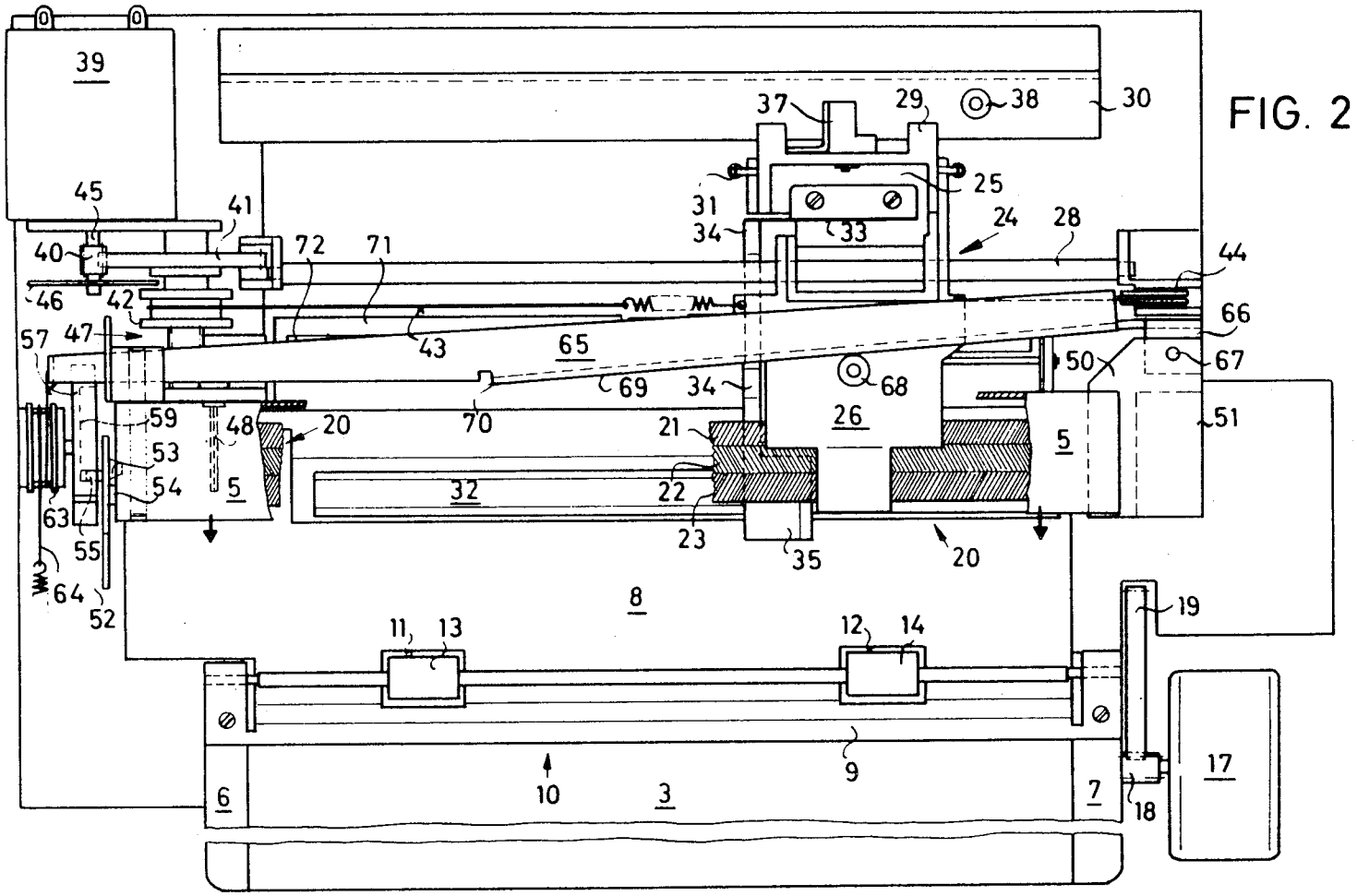
FIG. 2 is a top view showing the mechanism of the invention with the cover of the housing removed.

Referring now to the drawings and more particularly to FIGS. 1 and 2, the printing apparatus in accordance with the invention is shown as accommodated within a housing 1 which encloses the printing arrangement on all sides. At the front of the housing 1, there is provided an opening 2 through which there extends a guide table 3 for a recording carrier 36 which is to be inserted into the printing apparatus in a manner which is shown in greater detail in FIGS. 3 and 3A.

Figure 5:
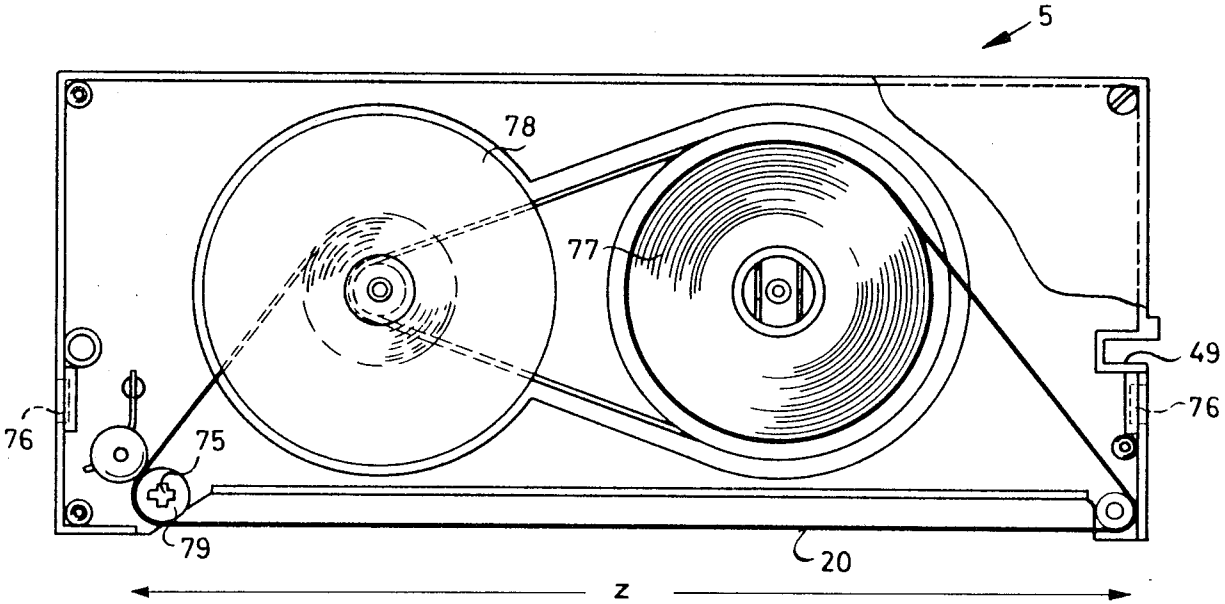
FIG. 5 is a top view of a color ribbon cartridge of the invention.

At the top of the housing 1, there is provided an opening 4 into which a color ribbon cartridge 5 may be inserted, the color ribbon cartridge 5 contains therein a color transfer ribbon 20 and as best seen in FIG. 1, the opening 4 in the housing 1 is formed with a width a which is approximately twice the height h of the cartridge 5. The cartridge 5 may be inserted in the housing 1 in cooperative relationship with the printing apparatus in a "standing" manner. This means that the axes of spools upon which the color transfer ribbon 20 is wound will extend horizontally with the cartridge 5 in the operative position. Referring to FIG. 5, in this connection, it will be seen that the cartridge 5 includes a pair of spools 77 and 78 about which the color transfer ribbon 20 is wound. It will be apparent from FIG. 5 that the spools 77 and 78 have parallel axes of rotation which extend perpendicularly to the plane of the drawing in FIG. 5. With the cartridge mounted in operative position within the printing apparatus, as shown in FIG. 1, the axes of the spools 77 and 78 extend essentially horizontally and this is referred to as a "standing" arrangement. In prior art devices, the axes of such spools usually lie essentially vertically and this arrangement is usually referred to as a "lying" arrangement.

The guide table 3 of the printing apparatus is provided with two lateral guide edges 6 and 7 as seen in FIG. 2 between which the recording carrier 36 may be inserted. An upper guide plate 8 is bent at a front edge 9 so that there occurs or is defined an insertion shaft or channel 10 for the recording carrier 36 upon which the printing is to be effected.

Contact pressure rollers 13 and 14 which cooperate with drive rollers 15 and 16 which are arranged in the guide table 3 extend through recesses 11 and 12 formed in the upper guide plate 8. The drive rollers 15 and 16 are driven by a motor 17 by means of gear wheels 18 and 19. The gear wheel 19 drives a shaft 19' upon which the drive rollers 15 and 16 are mounted. The motor 17 is capable of being driven in two directions so that it may move the recording carrier 36 in an intake direction as well as in a discharge direction.

In FIG. 2, the color ribbon 20 is shown as comprising three color zones 21, 22 and 23 which are yellow, magenta and cyan. The color ribbon 20 is drawn off from the supply spool 77 by means of a drive mechanism which acts on a roller 79 and the ribbon 20 is wound on the spool 78. Between he spools 77 and 78, there is defined a printing zone z through which the ribbon 20 passes. The zone z is defined outside of the cartridge 5 and lies below the cartridge 5 when the cartridge is inserted in the printing apparatus in the position shown in FIG. 1.

The printing apparatus includes a printing head 24 which consists of carrying members 25 and 26 and a thermohead 27 upon which the thermoprinting elements are carried. The carrying member 25 of the printing head 24 is guided upon an axle 28 and is arranged to be displaceable in the horizontal direction while simultaneously being guided at a stationary shoulder 30 through projections 29. Accordingly, the member 25 is movable only in the transverse direction and is not pivotable or subject to swiveling movement. In contrast thereto, the carrying member 26 is guided only on the axis 28 and is swiveled in the clockwise direction as seen in FIG. 1 in such a way that by operation of springs 31 suspended on both sides that the thermohead 27 is supported on the printing beam 32 when it is moved for a printing run from left to right.

Fastened between the parts 25 and 26 of the printing head 24, there is a resilient scraper or stripper 33 having a resilient bent projection or nose 34 which rests with its front end 35 on the guide plate 8, the front end 35 being maintained between the color ribbon 20 and the recording carrier 36, as shown particularly in FIGS. 3 and 3A, so that the ribbon 20 and the carrier 36 may be maintained separated.

It should be mentioned that the scraper 33, 34, 35 is arranged as a spring stirrup in such a way that it contacts the upper guide in a constantly resilient manner regardless of whether the print head 24 is located in its printing position (FIG. 1) or in its raised position (FIG. 3A).

A comparison of FIGS. 3 and 3A will show that in the printing direction (FIG. 3) the thermohead 27 is pressed against the color ribbon 20 and the recording carrier 36 while the scraper 34, 35 separates the color ribbon 20 from the recording carrier immediately after the printing operation.

By contrast, FIG. 3A shows that when the printing head 24 is swiveled in its raised position during a return run, it will be raised high enough to allow the color ribbon 20 with the printing zone z in its cartridge 5 to be introduced without difficulty between the printing head 24 and the scraper 34, 35 which is resiliently supported on the printing beam 32 and on the guide plate 8.

A swiveling movement of the printing head 24, and particularly of the member 26, with the part 27 securely connected thereto, against the force of the springs 31, occurs in that a swivel lever 37 is supported at the rear side of the member 25, the swivel lever 37 cooperating with a stop bolt 38 in one rightward position wherein the stop bolt 38 causes the swivel lever 37 to undergo a swiveling movement. The member 26 is also thereby swiveled relative to the member 25 and the members 26 and 27 are accordingly raised.

Figure 4:
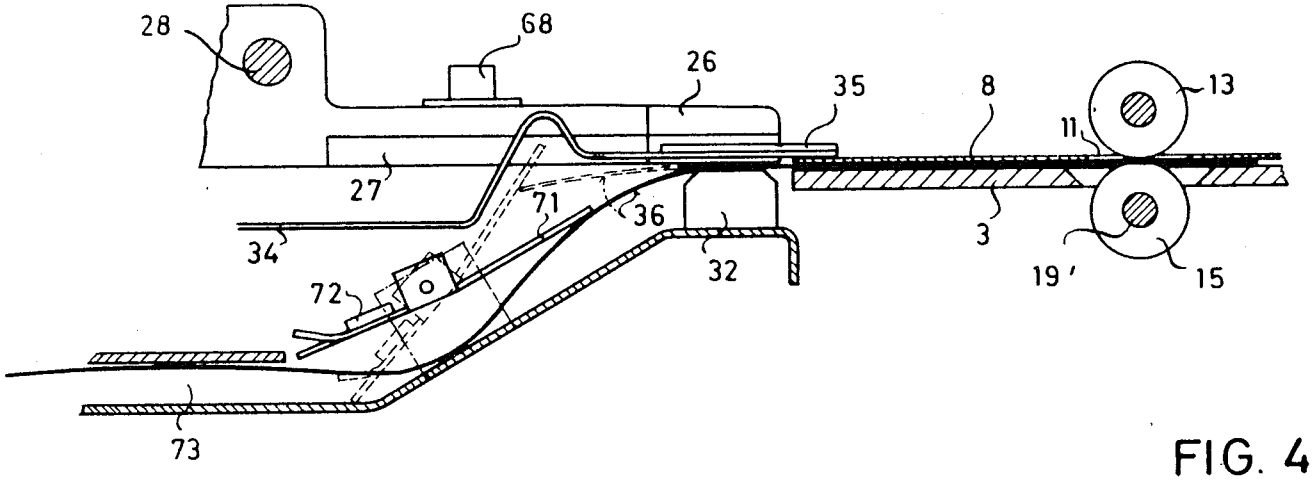
FIG. 4 is a detailed sectional view showing a paper guide mechanism of the invention.

On the other hand, with the printing head 24 at its leftmost position, the swivel lever 37 will cooperate with a releasing pawl or trip latch (not shown) which will cause it to swivel into its end position thereby bringing the printing head into printing position as shown in FIGS. 1, 3 and 4.

Drive of the printing head 24 in the line or printing direction, drive of the color ribbon 20 and the displacement of the color ribbon cartridge 5 are effected by a second motor 39 which drives a roller 42 by means of two gear wheels 40 and 41, the roller 42 operating to tension a drive belt 43. On the other side, the drive belt 43 is wound around a roller 44. The two ends of the belt are elastically suspended at the printing head 24. By means of a timing disk 46 which is connected with a motor shaft 45, the respective position of the printing head 24 is reported to an electronic control. The timing disk 46 cooperates with a light barrier (not shown). Reciprocal movement of the printing head 24 is effected by means of reversal of the rotational movement of the direct current motor 39.

A reduction or step-down gear unit 47 including a one-way clutch drives a drive element 48 which engages within a recess 75 of the roller 79 of the color ribbon cartridge 5 in order thereby to drive the color ribbon 20. The one-way coupling in the gear unit 47 ensures that the color ribbon is driven only during rearward movement of the printing head 24 when the parts 26 and 27 are in the inactive or raised position, as shown in FIG. 3A.

In order to effect operation of the apparatus, the cartridge 5 is inserted through the inserting opening 4 in the housing 1 and is connected with its drive means 48 and engaged so as to catch or lock with guide and stop means provided in the apparatus so as to be interposed between the cartridge 5 and the printing apparatus. At its right-hand border, the cartridge 5 is formed with a recess 49 within which there engages a guide shoulder 50 at a printer frame 51. The cartridge is provided at both sides with slots or recessed portions 76 within which resilient stop levers 52 engage with a nose or projection 53. For the sake of clarity, only the left stop lever 52 is shown in FIG. 2.

The resilient stop lever 52 is supported on an axle 54 (FIG. 1). A bolt 55 at the resilient stop lever 52 cooperates with a curved groove guide 56. The curved groove guide 56 is composed of a disk 57, having three stop slots 58 each of which are spaced from the other at an angle of 120° and a curved groove 59. The disk 57 is supported on a shaft 60. When the disk 57 is rotated by means of the shaft 60, the bolt 55 moves in the groove 59 in such a manner that the stop lever 52 is swiveled, specifically in three different positions corresponding to the three color components 21, 22 and 23 of the color ribbon 20.

In the position shown in FIG. 1, a stop spring 61 having a projection 62 is engaged with a stop slot 58 of the disk 57. In this position, the cartridge 5 is located to be retracted rearwardly to its furthest position. If the disk 57 is rotated through 120° in the clockwise direction so that the next stop slot 58 engages with the projection 62 at the stop spring 61, then the stop lever 52 will be swiveled in the clockwise direction as seen in FIG. 1 by means of the curved groove 59 and the bolt 55 thereby causing the next color zone 22 of the color ribbon 20 to be brought into working position.

If the disk 57 is again rotated through 120° so that the third stop slot 58 in the disk 57 is brought into cooperative engagement with the projection 62 at the spring 61, then the stop lever 52 is further swiveled to the right in the clockwise direction so that the third color zone 23 of the color ribbon 20 will be now in the working position During a next movement stroke of the disk 57, a rearward movement of the stop lever 52 occurs controlled by means of the curved groove 59 to bring the stop lever 52 into its initial position The disk 57 is connected with a belt pulley 63 by means of the shaft 60, the drive belt 64 being guided by means of the belt pulley 63. The drive belt 64 is elastically fastened at the drive lever 65 which is supported to be swiveled on a carrying bolt 67 by means of two bent ends 66. The drive lever 65 is actuated by a bolt 68 which is fastened on the carrying member 26 of the print head 24. For this purpose, the drive lever is provided with a bent edge 69 by means of which it is supported on the bolt 68.

When the print head 24 moves from right to left, as seen in FIG. 2, the drive lever 65 is swiveled and transmits its drive movement to the pulley 63 by means of the belt 64 and, accordingly, to the disk 57. The drive movement is terminated when the bolt 68 moves over the end 70 of the edge 69 so that further drive movement thereof cannot be transmitted. When the printing head 24 moves from left to right, the bolt 68 does not engage with the edge 69 because the printing head 24 is in its lowered position during this movement.

In the operation of the arrangement shown and described, the cartridge 5 is first inserted into the inserting opening 4, wherein it is held in position at the front boundary of the opening 4. As soon as the cartridge 5 strikes against the cover 8, it is pushed to the rear wherein the guide means 49, 50 cooperate, on the one hand, and the engagement with the stop means 52, 53, 76 and the drive means 47, 48 is produced, on the other hand. In so doing, the members 26, 27 of the print head 24 enter between the wall of the cartridge 5 and the color ribbon 20 into the printing zone z while the scraper 34, 35 comes to bear between the color ribbon 20 and the recording carrier 36 (see FIGS. 3, 3A).

A recording carrier 36 which is preferably of standard paper is placed upon the guide table 3 and is inserted through the insertion channel 10 until it contacts the drive and contact pressure rollers 13–16. The rollers are set in motion and convey the recording carrier 36 in such a manner that it will pass under the printing head 24 (see FIG. 3A) which is swiveled in its raised position, the carrier 36 also passing the printing beam 32. The recording carrier 36 then strikes against a paper inserting plate 71 seen particularly in FIG. 4, the inserting plate 71 being held in its normal position by means of a weight 72, which is the position indicated by dashed lines in FIG. 4, so that the carrier 36 will strike the plate 71 and be pushed back to a rear guide channel 73 of the printer.

The guide plate 71 then swivels out of the position indicated in dashed lines into the position indicated in solid lines as the recording medium passes therethrough with the inserting plate 71 then being in position to ensure that the recording carrier 36 is pressed down lightly during the printing process.

When the recording carrier 36 has reached its first line position, the printing apparatus is actuated by means of electronic control, with the motor 39 being actuated to move the printing head 24 back and forth whereby a color zone of the color ribbon 20 is brought into contact with the recording carrier 36 during each movement of the printing head 24 from left to right.

By contrast, when the printing head 24 moves from right to left, the printing head 24 is swiveled by means of the swivel lever 37 and the stop 38 so that it is not in contact with the color ribbon and the recording carrier. However, during this movement, as already discussed, the curved groove guide 56 is simultaneously moved by means of the drive lever 65 in such a manner that the color ribbon 20 is brought into a working connection at another color-zone for the next printing run of the printing head 24.

After three printing runs of the printing head, from left to right, a line is printed in color. The recording carrier is advanced by a line distance by means of the motor 17 and gear unit 18, 19 so that a new line can be again printed in three printing runs with respect to the color ribbon 20.

Accordingly, in accordance with the foregoing, it will be seen that the invention provides a coloring arrangement wherein a cartridge 5 is provided for a printer with color being transferred from the color ribbon to a recording carrier 36 by means of a single use color ribbon 20. In order to enable the greatest possible supply of color ribbon without thereby greatly increasing the space which is to be occupied by the color ribbon cartridge 5, and accordingly to avoid impairing the dimensioning of the printer itself, the invention provides an arrangement wherein the color ribbon cartridge 5 in the printer is in a "standing" position with the axes of the spools 77, 78 extending horizontally. This is in contrast to a "lying" position of the axes wherein the axes are arranged to be vertical. In such a standing arrangement of the cartridge 5, printing is effected by means of the print head 24 operating from above to below via the color ribbon 20 which is guided at the underside of the cartridge freely in front of the recording carrier 36 with the cartridge 5 projecting over the printer housing 1 according to the dimensioning of its spools by a desired amount so that no restrictions arise with respect to the dimensioning of the color ribbon supply.

With the arrangement of the invention, when the cartridge 5 is inserted in the opening 4, the guide and stop means 52, 53, 76, 49, 50 operate to simultaneously effect coupling with the color ribbon drive means 47, 48. The stop means 52, 53, 76 for the cartridge 5 are arranged so as to be swiveled and displaced, respectively, by means of drive means 55–70 in such a way that they effect a swiveling and displacement, respectively, of the cartridge 5 in a manner whereby three different color zones 21, 22, 23 of the color ribbon 20 are available.

The invention is particularly characterized in that the guide and stop means consists, on the one hand, of a recess 49 in the cartridge 5 and a guide shoulder 50 in the printer frame 51 and, on the other hand, of slots 76 in the cartridge 5 and swivelable, resilient stop levers 52 which engage in the slot 76. The stop means are adjustable in the individual stop positions by means of the curved groove guide 56 which is rotatable into a series of stop positions by means of the drive element 65 during each printing run of the printing head.

Thus, in accordance with the present invention, an arrangement is obtained wherein a one-time color ribbon may be provided which offers a maximum supply of ribbon without impairing or adversely affecting the spatial requirements of the printing apparatus.

While a specific embodiment of the invention has been shown and described in detail to illustrate the application of the inventive principles, it will be understood that the invention may be embodied otherwise without departing from such principles.

What is claimed is:

1. Printing apparatus having a coloring system comprising:

printing head means for performing a printing operation on a recording carrier, said printing head means operating to effect said printing operation from above said recording carrier;

color ribbon means operable in cooperation with said print head means to effect colored printing on said recording carrier, said color ribbon means comprising a cartridge, an elongated color ribbon contained within said cartridge having three different coextensive color zones thereon extending in the elongated direction of said ribbon and wound on and extending between a pair of spools within said cartridge said pair of spools rotatable about parallel axes;

a housing within which said printing head means is contained adapted to receive said cartridge with said parallel axes of said spools extending horizontally and with said color ribbon positioned at the underside of said cartridge guided for operative association with said recording carrier to enable said printing head means to effect a printing operation, said housing being provided with an inserting opening for said cartridge, said opening having a dimension which is twice the corresponding dimension of said cartridge inserted into the opening;

color ribbon drive means within said housing operatively engaging said cartridge and moving said color ribbon during a printing operation; and guide means and stop means interposed between said printing head means and said cartridge with said guide means arranged for moving said cartridge within said housing and said stop means arranged for holding said cartridge within said housing in operative position with said cartridge projecting above said housing to a degree in accordance with the dimension of said spools said guide means operating when said cartridge is inserted in said housing to effect coupling thereof with said color ribbon drive means; and said guide means comprising means for guiding movement of said cartridge relative to said printing head means along a linear path in directions parallel to said axes, and said stop means comprising crank means, arranged to be swiveled and displaced by drive means, for moving said cartridge along said linear path to displace said color ribbon along said linear path parallel to said recording carrier for positioning of a desired color zone relative to said printing heads means, wherein said means for guiding movement of said cartridge comprises a recess in said cartridge and a guide shoulder in said printing apparatus engaging within said recess to direct said cartridge along said linear path.

2. Apparatus according to claim 1, wherein said crank means comprise a rotatable disc member having a curved groove guide defined therein and a resilient lever engaging said curved groove guide and also engaging slots in said cartridge to drive said cartridge along said linear path upon rotation of said disc member.

3. Apparatus according to claim 2, wherein said stop means comprise a plurality of stops arranged to define positions at which said disc member is stopped during rotation thereof, said stops thereby operating to define the positions to which said cartridge is moved to position a desired color zone relative to said print head means.

* * * * *

UNITED STATES PATENT AND TRADEMARK OFFICE

CERTIFICATE OF CORRECTION

PATENT NO. : 4,810,118

DATED : March 7, 1989

INVENTOR(S) : Josef Hauger et al

It is certified that error appears in the above-identified patent and that said Letters Patent is hereby corrected as shown below:

In the heading of the Patent, it should read:

[30] Foreign Application Priority Data

August 31, 1983 Fed. Rep. of Germany ..... P3331388

June 6, 1984 Fed. Rep. of Germany ..... P3420981

Signed and Sealed this

Thirty-first Day of October, 1989

*Attest:*

*Attesting Officer*

DONALD J. QUIGG

*Commissioner of Patents and Trademarks*